US007870904B2

(12) United States Patent
Hocking

(10) Patent No.: US 7,870,904 B2
(45) **Date of Patent: *Jan. 18, 2011**

(54) ENHANCED HYDROCARBON RECOVERY BY STEAM INJECTION OF OIL SAND FORMATIONS

(75) Inventor: Grant Hocking, Alpharetta, GA (US)

(73) Assignee: GeoSierra LLC, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/370,244

(22) Filed: Feb. 12, 2009

(65) Prior Publication Data

US 2010/0276147 A9 Nov. 4, 2010

Related U.S. Application Data

(63) Continuation of application No. 11/626,112, filed on Jan. 23, 2007, now Pat. No. 7,591,306, and a continuation-in-part of application No. 11/363,540, filed on Feb. 27, 2006, now Pat. No. 7,748,458, said application No. 11/626,112 is a continuation-in-part of application No. 11/379,828, filed on Apr. 24, 2006, now abandoned, which is a continuation-in-part of application No. 11/379,123, filed on Apr. 18, 2006, now abandoned, which is a continuation-in-part of application No. 11/278,470, filed on Apr. 3, 2006, now abandoned, which is a continuation-in-part of application No. 11/277,789, filed on Mar. 29, 2006, now abandoned, which is a continuation-in-part of application No. 11/277,815, filed on Mar. 29, 2006, now abandoned, which is a continuation-in-part of application No. 11/277,775, filed on Mar. 29, 2006, now abandoned, which is a continuation-in-part of application No. 11/277,308, filed on Mar. 23, 2006, now abandoned.

(51) Int. Cl.
*E21B 43/26* (2006.01)
*E21B 36/00* (2006.01)

(52) U.S. Cl. ..... 166/302; 166/62; 166/308.2

(58) Field of Classification Search ..... None
See application file for complete search history.

(56) References Cited

U.S. PATENT DOCUMENTS

| | | | |
|---|---|---|---|
| 1,789,993 | A | 1/1931 | Switzer |
| 2,178,554 | A | 11/1939 | Bowie |
| 2,548,360 | A | 4/1951 | Germain |
| 2,634,961 | A | 4/1953 | Ljungström |
| 2,732,195 | A | 1/1956 | Ljungström |
| 2,780,450 | A | 2/1957 | Ljungström |
| 3,059,909 | A | 10/1962 | Wise |

(Continued)

*Primary Examiner*—Zakiya W Bates
*Assistant Examiner*—Angela M Ditrani
(74) *Attorney, Agent, or Firm*—Smith, Gambrell & Russell

(57) ABSTRACT

A method and apparatus for enhanced recovery of petroleum fluids from the subsurface by injection of a steam and hydrocarbon vaporized solvent in contact with the oil sand formation and the heavy oil and bitumen in situ. Multiple propped hydraulic fractures are constructed from the well bore into the oil sand formation and filled with a highly permeable proppant. Steam, a hydrocarbon solvent, and a non-condensing diluent gas are injected into the propped fractures, and flows upwards and outwards to contact and heat the in situ bitumen, which softens and flows by gravity to the well bore, and is pumped to the surface where the solvent can be recycled for further injection.

56 Claims, 4 Drawing Sheets

U.S. PATENT DOCUMENTS 3,225,828 A 12/1965 Wisenbaker
3,301,723 A 1/1967 Chrisp
3,349,847 A 10/1967 Smith et al.
3,739,852 A 6/1973 Woods et al.
3,888,312 A 6/1975 Tiner et al.
3,994,340 A 11/1976 Anderson et al.
4,085,803 A 4/1978 Butler
4,099,570 A 7/1978 Vandergrift
4,116,275 A 9/1978 Butler et al.
4,119,151 A 10/1978 Smith
4,271,696 A 6/1981 Wood
4,280,559 A 7/1981 Best
4,344,485 A 8/1982 Butler
4,450,913 A 5/1984 Allen et al.
4,454,916 A 6/1984 Shu
4,474,237 A 10/1984 Shu
4,513,819 A 4/1985 Islip et al.
4,519,454 A 5/1985 McMillen
4,566,536 A 1/1986 Holmes
4,597,441 A 7/1986 Ware et al.
4,598,770 A 7/1986 Shu et al.
4,625,800 A 12/1986 Venkatesan
4,696,345 A 9/1987 Hsueh
4,697,642 A 10/1987 Vogel
4,706,751 A 11/1987 Gondouin
4,716,960 A 1/1988 Eastlund et al.
4,926,941 A 5/1990 Glandt et al.
4,993,490 A 2/1991 Stephens et al.
5,002,431 A 3/1991 Heymans
5,046,559 A 9/1991 Glandt
5,054,551 A 10/1991 Duerksen
5,060,287 A 10/1991 Van Egmond
5,060,726 A 10/1991 Glandt et al.
5,065,818 A 11/1991 Van Egmond
5,103,911 A 4/1992 Heijnen
5,145,003 A 9/1992 Duerksen
5,211,230 A 5/1993 Ostapovich et al.
5,215,146 A 6/1993 Sanchez
5,255,742 A 10/1993 Mikus
5,273,111 A 12/1993 Brannan et al.
5,297,626 A 3/1994 Vinegar et al.
5,335,724 A 8/1994 Venditto
5,339,897 A 8/1994 Leaute
5,372,195 A 12/1994 Swanson
5,392,854 A 2/1995 Vinegar et al.
5,404,952 A 4/1995 Vinegar et al.
5,407,009 A 4/1995 Butler et al.
5,431,224 A 7/1995 Laali
5,472,049 A 12/1995 Chaffee
5,607,016 A 3/1997 Butler
5,626,191 A 5/1997 Greaves et al.
5,824,214 A 10/1998 Paul et al.
5,862,858 A 1/1999 Wellington et al.
5,871,637 A 2/1999 Brons
5,899,269 A 5/1999 Wellington et al.
5,899,274 A 5/1999 Frauenfeld et al.
5,954,946 A 9/1999 Klazinga et al.
6,023,554 A 2/2000 Vinegar et al.
6,056,057 A 5/2000 Vinegar et al.
6,076,046 A 6/2000 Vasudevan
6,079,499 A 6/2000 Mikus et al.
6,216,783 B1 4/2001 Hocking et al.
6,318,464 B1 11/2001 Mokrys
6,360,819 B1 3/2002 Vinegar
6,372,678 B1 4/2002 Youngman et al.
6,412,557 B1 7/2002 Ayasse et al.
6,443,227 B1 9/2002 Hocking et al.
6,591,908 B2 7/2003 Nasr
6,708,759 B2 3/2004 Leaute et al.
6,722,431 B2 4/2004 Karanikas et al.
6,769,486 B2 8/2004 Lim et al.
6,883,607 B2 4/2005 Nenniger et al.
6,991,037 B2 * 1/2006 Hocking ..... 166/308.1
7,404,441 B2 * 7/2008 Hocking ..... 166/308.1
7,591,306 B2 * 9/2009 Hocking ..... 166/250.1
2007/0199698 A1 * 8/2007 Hocking ..... 166/250.1
2008/0115935 A1 5/2008 Mango

* cited by examiner

ENHANCED HYDROCARBON RECOVERY BY STEAM INJECTION OF OIL SAND FORMATIONS

RELATED APPLICATION

This application is a continuation of Ser. No. 11/626,112, filed Jan. 23, 2007, now U.S. Pat. No. 7,591,306 issued on Sep. 22, 2009, and is a continuation-in-part of U.S. application Ser. No. 11/363,540, filed Feb. 27, 2006 now U.S. Pat. No. 7,748,458.

U.S. Pat. No. 7,591,306 is a continuation-in-part of U.S. patent application Ser. No. 11/363,540, which is a continuation-in-part of U.S. application Ser. No. 11/277,308, filed Mar. 23, 2006, abandoned, U.S. application Ser. No. 11/277,775, filed Mar. 29, 2006, abandoned, U.S. application Ser. No. 11/277,815, filed Mar. 29, 2006, abandoned, U.S. application Ser. No. 11/277,789, filed Mar. 29, 2006, abandoned, U.S. application Ser. No. 11/278,470, filed Apr. 3, 2006, abandoned, U.S. application Ser. No. 11/379,123, filed Apr. 18, 2006, abandoned, and U.S. application Ser. No. 11/379,828, filed Apr. 24, 2006, abandoned.

TECHNICAL FIELD

The present invention generally relates to enhanced recovery of petroleum fluids from the subsurface by the injection of steam in the oil sand formation contacting the viscous heavy oil and bitumen in situ, and more particularly to a method and apparatus to extract a particular fraction of the in situ hydrocarbon reserve by controlling the access to the in situ bitumen, the steam and solvent composition, and operating temperatures and pressures of the in situ process, resulting in increased production of petroleum fluids from the subsurface formation as well as limiting water inflow into the process zone.

BACKGROUND OF THE INVENTION

Heavy oil and bitumen oil sands are abundant in reservoirs in many parts of the world such as those in Alberta, Canada, Utah and California in the United States, the Orinoco Belt of Venezuela, Indonesia, China and Russia. The hydrocarbon reserves of the oil sand deposit is extremely large in the trillions of barrels, with recoverable reserves estimated by current technology in the 300 billion barrels for Alberta, Canada and a similar recoverable reserve for Venezuela. These vast heavy oil (defined as the liquid petroleum resource of less than 20° API gravity) deposits are found largely in unconsolidated sandstones, being high porosity permeable cohesionless sands with minimal grain to grain cementation. The hydrocarbons are extracted from the oils sands either by mining or in situ methods.

The heavy oil and bitumen in the oil sand deposits have high viscosity at reservoir temperatures and pressures. While some distinctions have arisen between tar and oil sands, bitumen and heavy oil, these terms will be used interchangeably herein. The oil sand deposits in Alberta, Canada extend over many square miles and vary in thickness up to hundreds of feet thick. Although some of these deposits lie close to the surface and are suitable for surface mining, the majority of the deposits are at depth ranging from a shallow depth of 150 feet down to several thousands of feet below ground surface. The oil sands located at these depths constitute some of the world's largest presently known petroleum deposits. The oil sands contain a viscous hydrocarbon material, commonly referred to as bitumen, in an amount that ranges up to 15% by weight. Bitumen is effectively immobile at typical reservoir temperatures. For example at 15° C., bitumen has a viscosity of ~1,000,000 centipoise. However, at elevated temperatures the bitumen viscosity changes considerably to ~350 centipoise at 100° C. down to ~10 centipoise at 180° C. The oil sand deposits have an inherently high permeability ranging from ~1 to 10 Darcy, thus upon heating, the heavy oil becomes mobile and can easily drain from the deposit.

Solvents applied to the bitumen soften the bitumen and reduce its viscosity and provide a non-thermal mechanism to improve the bitumen mobility. Hydrocarbon solvents consist of vaporized light hydrocarbons such as ethane, propane, or butane or liquid solvents such as pipeline diluents, natural condensate streams, or fractions of synthetic crudes. The diluent can be added to steam and flashed to a vapor state or be maintained as a liquid at elevated temperature and pressure, depending on the particular diluent composition. While in contact with the bitumen, the saturated solvent vapor dissolves into the bitumen. This diffusion process is due to the partial pressure difference between the saturated solvent vapor and the bitumen. As a result of the diffusion of the solvent into the bitumen, the oil in the bitumen becomes diluted and mobile and will flow under gravity. The resultant mobile oil may be deasphalted by the condensed solvent, leaving the heavy asphaltenes behind within the oil sand pore space with little loss of inherent fluid mobility in the oil sands due to the small weight percent (5-15%) of the asphaltene fraction to the original oil in place. Deasphalting the oil from the oil sands produces a high grade quality product by 3°-5° API gravity. If the reservoir temperature is elevated the diffusion rate of the solvent into the bitumen is raised considerably being two orders of magnitude greater at 100° C. compared to ambient reservoir temperatures of ~15° C.

In situ methods of hydrocarbon extraction from the oil sands consist of cold production, in which the less viscous petroleum fluids are extracted from vertical and horizontal wells with sand exclusion screens, CHOPS (cold heavy oil production system) cold production with sand extraction from vertical and horizontal wells with large diameter perforations thus encouraging sand to flow into the well bore, CSS (cyclic steam stimulation) a huff and puff cyclic steam injection system with gravity drainage of heated petroleum fluids using vertical and horizontal wells, stream flood using injector wells for steam injection and producer wells on 5 and 9 point layout for vertical wells and combinations of vertical and horizontal wells, SAGD (steam assisted gravity drainage) steam injection and gravity production of heated hydrocarbons using two horizontal wells, VAPEX (vapor assisted petroleum extraction) solvent vapor injection and gravity production of diluted hydrocarbons using horizontal wells, and combinations of these methods.

Cyclic steam stimulation and steam flood hydrocarbon enhanced recovery methods have been utilized worldwide, beginning in 1956 with the discovery of CSS, huff and puff or steam-soak in Mene Grande field in Venezuela and for steam flood in the early 1960s in the Kern River field in California. These steam assisted hydrocarbon recovery methods including a combination of steam and solvent are described, see U.S. Pat. No. 3,739,852 to Woods et al, U.S. Pat. No. 4,280,559 to Best, U.S. Pat. No. 4,519,454 to McMillen, U.S. Pat. No. 4,697,642 to Vogel, and U.S. Pat. No. 6,708,759 to Leaute et al. The CSS process raises the steam injection pressure above the formation fracturing pressure to create fractures within the formation and enhance the surface area access of the steam to the bitumen. Successive steam injection cycles reenter earlier created fractures and thus the process becomes less efficient over time. CSS is generally practiced in vertical wells, but systems are operational in horizontal wells, but have complications due to localized fracturing and steam entry and the lack of steam flow control along the long length of the horizontal well bore.

Descriptions of the SAGD process and modifications are described, see U.S. Pat. No. 4,344,485 to Butler, and U.S. Pat. No. 5,215,146 to Sanchez and thermal extraction methods in U.S. Pat. No. 4,085,803 to Butler, U.S. Pat. No. 4,099,570 to Vandergrift, and U.S. Pat. No. 4,116,275 to Butler et al. The SAGD process consists of two horizontal wells at the bottom of the hydrocarbon formation, with the injector well located approximately 10-15 feet vertically above the producer well. The steam injection pressures exceed the formation fracturing pressure in order to establish connection between the two wells and develop a steam chamber in the oil sand formation. Similar to CSS, the SAGD method has complications, albeit less severe than CSS, due to the lack of steam flow control along the long section of the horizontal well and the difficulty of controlling the growth of the steam chamber.

A thermal steam extraction process referred to a HASDrive (heated annulus steam drive) and modifications thereof are described to heat and hydrogenate the heavy oils in situ in the presence of a metal catalyst, see U.S. Pat. No. 3,994,340 to Anderson et al, U.S. Pat. No. 4,696,345 to Hsueh, U.S. Pat. No. 4,706,751 to Gondouin, U.S. Pat. No. 5,054,551 to Duerksen, and U.S. Pat. No. 5,145,003 to Duerksen. It is disclosed that at elevated temperature and pressure the injection of hydrogen or a combination of hydrogen and carbon monoxide to the heavy oil in situ in the presence of a metal catalyst will hydrogenate and thermal crack at least a portion of the petroleum in the formation.

Thermal recovery processes using steam require large amounts of energy to produce the steam, using either natural gas or heavy fractions of produced synthetic crude. Burning these fuels generates significant quantities of greenhouse gases, such as carbon dioxide. Also, the steam process uses considerable quantities of water, which even though may be reprocessed, involves recycling costs and energy use. Therefore a less energy intensive oil recovery process is desirable.

Solvent assisted recovery of hydrocarbons in continuous and cyclic modes are described including the VAPEX process and combinations of steam and solvent plus heat, see U.S. Pat. No. 4,450,913 to Allen et al, U.S. Pat. No. 4,513,819 to Islip et al, U.S. Pat. No. 5,407,009 to Butler et al, U.S. Pat. No. 5,607,016 to Butler, U.S. Pat. No. 5,899,274 to Frauenfeld et al, U.S. Pat. No. 6,318,464 to Mokrys, U.S. Pat. No. 6,769,486 to Lim et al, and U.S. Pat. No. 6,883,607 to Nenniger et al. The VAPEX process generally consists of two horizontal wells in a similar configuration to SAGD; however, there are variations to this including spaced horizontal wells and a combination of horizontal and vertical wells. The startup phase for the VAPEX process can be lengthy and take many months to develop a controlled connection between the two wells and avoid premature short circuiting between the injector and producer. The VAPEX process with horizontal wells has similar issues to CSS and SAGD in horizontal wells, due to the lack of solvent flow control along the long horizontal well bore, which can lead to non-uniformity of the vapor chamber development and growth along the horizontal well bore.

Direct heating and electrical heating methods for enhanced recovery of hydrocarbons from oil sands have been disclosed in combination with steam, hydrogen, catalysts and/or solvent injection at temperatures to ensure the petroleum fluids gravity drain from the formation and at significantly higher temperatures (300° to 400° range and above) to pyrolysis the oil sands. See U.S. Pat. No. 2,780,450 to Ljungstrom, U.S. Pat. No. 4,597,441 to Ware et al, U.S. Pat. No. 4,926,941 to Glandt et al, U.S. Pat. No. 5,046,559 to Glandt, U.S. Pat. No. 5,060,726 to Glandt et al, U.S. Pat. No. 5,297,626 to Vinegar et al, U.S. Pat. No. 5,392,854 to Vinegar et al, and U.S. Pat. No. 6,722,431 to Karanikas et al. In situ combustion processes have also been disclosed see U.S. Pat. No. 5,211,230 to Ostapovich et al, U.S. Pat. No. 5,339,897 to Leaute, U.S. Pat. No. 5,413,224 to Laali, and U.S. Pat. No. 5,954,946 to Klazing a et al. In situ processes involving downhole heaters are described in U.S. Pat. No. 2,634,961 to Ljungstrom, U.S. Pat. No. 2,732,195 to Ljungstrom, U.S. Pat. No. 2,780,450 to Ljungstrom. Electrical heaters are described for heating viscous oils in the forms of downhole heaters and electrical heating of tubing and/or casing, see U.S. Pat. No. 2,548,360 to Germain, U.S. Pat. No. 4,716,960 to Eastlund et al, U.S. Pat. No. 5,060,287 to Van Egmond, U.S. Pat. No. 5,065,818 to Van Egmond, U.S. Pat. No. 6,023,554 to Vinegar and U.S. Pat. No. 6,360,819 to Vinegar. Flameless downhole combustor heaters are described, see U.S. Pat. No. 5,255,742 to Mikus, U.S. Pat. No. 5,404,952 to Vinegar et al, U.S. Pat. No. 5,862,858 to Wellington et al, and U.S. Pat. No. 5,899,269 to Wellington et al. Surface fired heaters or surface burners may be used to heat a heat transferring fluid pumped downhole to heat the formation as described in U.S. Pat. No. 6,056,057 to Vinegar et al and U.S. Pat. No. 6,079,499 to Mikus et al.

The thermal and solvent methods of enhanced oil recovery from oil sands, all suffer from a lack of surface area access to the in place bitumen. Thus the reasons for raising steam pressures above the fracturing pressure in CSS and during steam chamber development in SAGD, are to increase surface area of the steam with the in place bitumen. Similarly the VAPEX process is limited by the available surface area to the in place bitumen, because the diffusion process at this contact controls the rate of softening of the bitumen. Likewise during steam chamber growth in the SAGD process the contact surface area with the in place bitumen is virtually a constant, thus limiting the rate of heating of the bitumen. Therefore both methods (heat and solvent) or a combination thereof would greatly benefit from a substantial increase in contact surface area with the in place bitumen. Hydraulic fracturing of low permeable reservoirs has been used to increase the efficiency of such processes and CSS methods involving fracturing are described in U.S. Pat. No. 3,739,852 to Woods et al, U.S. Pat. No. 5,297,626 to Vinegar et al, and U.S. Pat. No. 5,392,854 to Vinegar et al. Also during initiation of the SAGD process over pressurized conditions are usually imposed to accelerated the steam chamber development, followed by a prolonged period of under pressurized condition to reduce the steam to oil ratio. Maintaining reservoir pressure during heating of the oil sands has the significant benefit of minimizing water inflow to the heated zone and to the well bore.

Hydraulic fracturing of petroleum recovery wells enhances the extraction of fluids from low permeable formations due to the high permeability of the induced fracture and the size and extent of the fracture. A single hydraulic fracture from a well bore results in increased yield of extracted fluids from the formation. Hydraulic fracturing of highly permeable unconsolidated formations has enabled higher yield of extracted fluids from the formation and also reduced the inflow of formation sediments into the well bore. Typically the well casing is cemented into the borehole, and the casing perforated with shots of generally 0.5 inches in diameter over the depth interval to be fractured. The formation is hydraulically fractured by injecting fracture fluid into the casing, through the perforations and into the formation. The hydraulic connectivity of the hydraulic fracture or fractures formed in the formation may be poorly connected to the well bore due to restrictions and damage due to the perforations. Creating a hydraulic fracture in the formation that is well connected hydraulically to the well bore will increase the yield from the well, result in less inflow of formation sediments into the well bore and result in greater recovery of the petroleum reserves from the formation.

Turning now to the prior art, hydraulic fracturing of subsurface earth formations to stimulate production of hydrocarbon fluids from subterranean formations has been carried out in many parts of the world for over fifty years. The earth is hydraulically fractured either through perforations in a cased well bore or in an isolated section of an open bore hole. The horizontal and vertical orientation of the hydraulic fracture is controlled by the compressive stress regime in the earth and the fabric of the formation. It is well known in the art of rock mechanics that a fracture will occur in a plane perpendicular to the direction of the minimum stress, see U.S. Pat. No. 4,271,696 to Wood. At significant depth, one of the horizontal stresses is generally at a minimum, resulting in a vertical fracture formed by the hydraulic fracturing process. It is also well known in the art that the azimuth of the vertical fracture is controlled by the orientation of the minimum horizontal stress in consolidated sediments and brittle rocks.

At shallow depths, the horizontal stresses could be less or greater than the vertical overburden stress. If the horizontal stresses are less than the vertical overburden stress, then vertical fractures will be produced; whereas if the horizontal stresses are greater than the vertical overburden stress, then a horizontal fracture will be formed by the hydraulic fracturing process.

Hydraulic fracturing generally consists of two types, propped and unpropped fracturing. Unpropped fracturing consists of acid fracturing in carbonate formations and water or low viscosity water slick fracturing for enhanced gas production in tight formations. Propped fracturing of low permeable rock formations enhances the formation permeability for ease of extracting petroleum hydrocarbons from the formation. Propped fracturing of high permeable formations is for sand control, i.e. to reduce the inflow of sand into the well bore, by placing a highly permeable propped fracture in the formation and pumping from the fracture thus reducing the pressure gradients and fluid velocities due to draw down of fluids from the well bore. Hydraulic fracturing involves the literally breaking or fracturing the rock by injecting a specialized fluid into the well bore passing through perforations in the casing to the geological formation at pressures sufficient to initiate and/or extend the fracture in the formation. The theory of hydraulic fracturing utilizes linear elasticity and brittle failure theories to explain and quantify the hydraulic fracturing process. Such theories and models are highly developed and generally sufficient for the art of initiating and propagating hydraulic fractures in brittle materials such as rock, but are totally inadequate in the understanding and art of initiating and propagating hydraulic fractures in ductile materials such as unconsolidated sands and weakly cemented formations.

Hydraulic fracturing has evolved into a highly complex process with specialized fluids, equipment and monitoring systems. The fluids used in hydraulic fracturing vary depending on the application and can be water, oil or multi-phased based gels. Aqueous based fracturing fluids consist of a polymeric gelling agent such as solvatable (or hydratable) polysaccharide, e.g. galactomannan gums, glycomannan gums, and cellulose derivatives. The purpose of the hydratable polysaccharides is to thicken the aqueous solution and thus act as viscosifiers, i.e. increase the viscosity by 100 times or more over the base aqueous solution. A cross-linking agent can be added which further increases the viscosity of the solution. The borate ion has been used extensively as a cross-linking agent for hydrated guar gums and other galactomannans, see U.S. Pat. No. 3,059,909 to Wise. Other suitable cross-linking agents are chromium, iron, aluminum, and zirconium (see U.S. Pat. No. 3,301,723 to Chrisp) and titanium (see U.S. Pat. No. 3,888,312 to Tiner et al). A breaker is added to the solution to controllably degrade the viscous fracturing fluid. Common breakers are enzymes and catalyzed oxidizer breaker systems, with weak organic acids sometimes used.

Oil based fracturing fluids are generally based on a gel formed as a reaction product of aluminum phosphate ester and a base, typically sodium aluminate. The reaction of the ester and base creates a solution that yields high viscosity in diesels or moderate to high API gravity hydrocarbons. Gelled hydrocarbons are advantageous in water sensitive oil producing formations to avoid formation damage, that would otherwise be caused by water based fracturing fluids.

The method of controlling the azimuth of a vertical hydraulic fracture in formations of unconsolidated or weakly cemented soils and sediments by slotting the well bore or installing a pre-slotted or weakened casing at a predetermined azimuth has been disclosed. The method disclosed that a vertical hydraulic fracture can be propagated at a pre-determined azimuth in unconsolidated or weakly cemented sediments and that multiple orientated vertical hydraulic fractures at differing azimuths from a single well bore can be initiated and propagated for the enhancement of petroleum fluid production from the formation. See U.S. Pat. No. 6,216,783 to Hocking et al, U.S. Pat. No. 6,443,227 to Hocking et al, U.S. Pat. No. 6,991,037 to Hocking, U.S. application Ser. No. 11/363,540 and U.S. application Ser. No. 11/277,308. The method disclosed that a vertical hydraulic fracture can be propagated at a pre-determined azimuth in unconsolidated or weakly cemented sediments and that multiple orientated vertical hydraulic fractures at differing azimuths from a single well bore can be initiated and propagated for the enhancement of petroleum fluid production from the formation. It is now known that unconsolidated or weakly cemented sediments behave substantially different from brittle rocks from which most of the hydraulic fracturing experience is founded.

Accordingly, there is a need for a method and apparatus for enhancing the extraction of hydrocarbons from oil sands by direct heating, steam and/or solvent injection, or a combination thereof and controlling the subsurface environment, both temperature and pressure to optimize the hydrocarbon extraction in terms of produced rate, efficiency, and produced product quality, as well as limit water inflow into the process zone.

SUMMARY OF THE INVENTION

The present invention is a method and apparatus for enhanced recovery of petroleum fluids from the subsurface by injection of steam in contact with the oil sand formation and the heavy oil and bitumen in situ. Multiple propped hydraulic fractures are constructed from the well bore into the oil sand formation and filled with a highly permeable proppant. Steam is injected into the well bore and the propped fractures at or near the ambient reservoir pressure but substantially below the reservoir fracturing pressure. The injected steam flows upwards and outwards in the propped fractures contacting the oil sands and in situ bitumen on the vertical faces of the propped fractures. The steam condenses onto the cool bitumen and the latent heat of the steam diffuse into the bitumen from the vertical faces of the propped fractures. The bitumen softens and flows by gravity to the well bore, exposing fresh surface of bitumen for the process to progressively soften and mobilize the bitumen in a predominantly circumferential, i.e. orthogonal to the propped fracture, diffusion direction at a nearly uniform rate into the oil sand deposit. To limit upward growth of the process, a light non-condensing gas can be injected to remain in the uppermost portions of the propped fractures. The mobile oil may be deasphalted by co-injection of a hydrocarbon solvent with the steam, leaving the heavy asphaltenes behind in the oil sand pore space with little loss of inherent fluid mobility in the processed oil sands. The processed hydrocarbon product with the dissolved solvent is produced from the formation and steam along with a hydrocarbon solvent is re-injected into the process zone and the cycle repeats.

The processes active at the contact of the inject steam and solvent with the bitumen in the oil sand are predominantly diffusive, being driven by partial pressure and temperature gradients, resulting in the diffusion of hydrocarbon solvent and heat into the bitumen. Upon softening of the bitumen, the oil will become mobile and flow under gravity and exposed contact with fresh bitumen in situ for an every larger expanding zone of mobile oil in the native oil sand formation. The mobile oil flows by gravity with the dissolved solvent back to the well bore and pumped to the surface.

The hydrocarbon solvent would preferably be one of ethane, propane, or butane or a mixture thereof, and be mixed with a non-condensing diluent gas being either methane, nitrogen, carbon dioxide, natural gas, or a mixture thereof, to ensure that the selected composition of the injected gas is such that: 1) the solvent mixture has a dew point that substantially corresponds with the operating process temperature and pressure in situ, 2) the solvent mixture is substantially more soluble in the bitumen than the diluent gas, 3) the solvent mixture is liquefied but vaporizable in the process zone, and 4) solvent mixture has a vapor/liquid envelop that encompasses the process operating temperatures and pressures. The solvent and diluent gas are injected with the steam into the well bore and the process zone, with the solvent primarily as a vapor state contacting and diffusing into the bitumen. By selecting the appropriate solvent, diluent gas, and steam mixture, the process can operate close to ambient reservoir pressures, so that water inflow into the process zone can be minimized. The selected range of temperatures and pressures to operate the process will depend on reservoir depth, ambient conditions, quality of the in place heavy oil and bitumen, composition of the solvent, diluent gas and steam mixture, and the presence of nearby water bodies. At such elevated temperatures, the diffusion rate of the solvent diffusing into the bitumen is significantly greater than at reservoir ambient temperatures.

As the steam solvent mixture is injected and contacts the in situ bitumen, the steam condenses onto the cool bitumen and thus heats the bitumen by conduction. As the gas mixture contacts the bitumen, the oil becomes diluted with solvent and heated by the steam, softens and flows by gravity to the well bore. The flowing oil contains dissolved solvent. The produced product of oil and dissolved solvent is pumped to the surface where the solvent can be recycled for further injection.

Although the present invention contemplates the formation of fractures which generally extend laterally away from a vertical or near vertical well penetrating an earth formation and in a generally vertical plane, those skilled in the art will recognize that the invention may be carried out in earth formations wherein the fractures and the well bores can extend in directions other than vertical.

Therefore, the present invention provides a method and apparatus for enhanced recovery of petroleum fluids from the subsurface by steam and vaporized solvents placed in the oil sand formation contacting the viscous heavy oil and bitumen in situ, and more particularly to a method and apparatus to extract a particular fraction of the in situ hydrocarbon reserve by controlling the access to the in situ bitumen, the steam solvent composition, and operating temperatures and pressures of the in situ process, resulting in increased production of petroleum fluids from the subsurface formation as well as limiting water inflow into the process zone.

Other objects, features and advantages of the present invention will become apparent upon reviewing the following description of the preferred embodiments of the invention, when taken in conjunction with the drawings and the claims.

DETAILED DESCRIPTION OF THE DISCLOSED EMBODIMENT

Several embodiments of the present invention are described below and illustrated in the accompanying drawings. The present invention is a method and apparatus for enhanced recovery of petroleum fluids from the subsurface by injection of steam and a hydrocarbon vaporized solvent in contact with the oil sand formation and the heavy oil and bitumen in situ. Multiple propped hydraulic fractures are constructed from the well bore into the oil sand formation and filled with a highly permeable proppant. Steam, a hydrocarbon solvent, and a non-condensing diluent gas are injected into the well bore and the propped fractures. The injected gas flows upwards and outwards in the propped fractures contacting the oil sands and in situ bitumen on the vertical faces of the propped fractures. The steam condenses on the cool bitumen and thus heats the bitumen by conduction, while the hydrocarbon solvent vapors diffuse into the bitumen from the vertical faces of the propped fractures. The bitumen softens and flows by gravity to the well bore, exposing fresh surface of bitumen for the process to progressively soften and mobilize the bitumen in a predominantly circumferential, i.e. orthogonal to the propped fracture, diffusion direction at a nearly uniform rate into the oil sand deposit. The produced product of oil and dissolved solvent is pumped to the surface where the solvent can be recycled for further injection.

Figure 2:
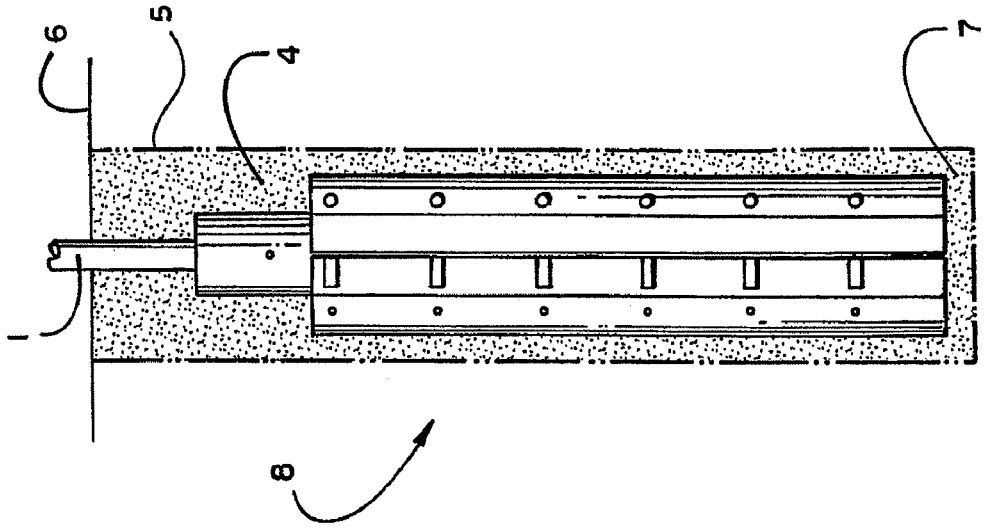
FIG. 2 is a cross-sectional side elevation view of a well casing having dual fracture winged initiation sections prior to initiation of multiple azimuth controlled vertical fractures.
Figure 1:
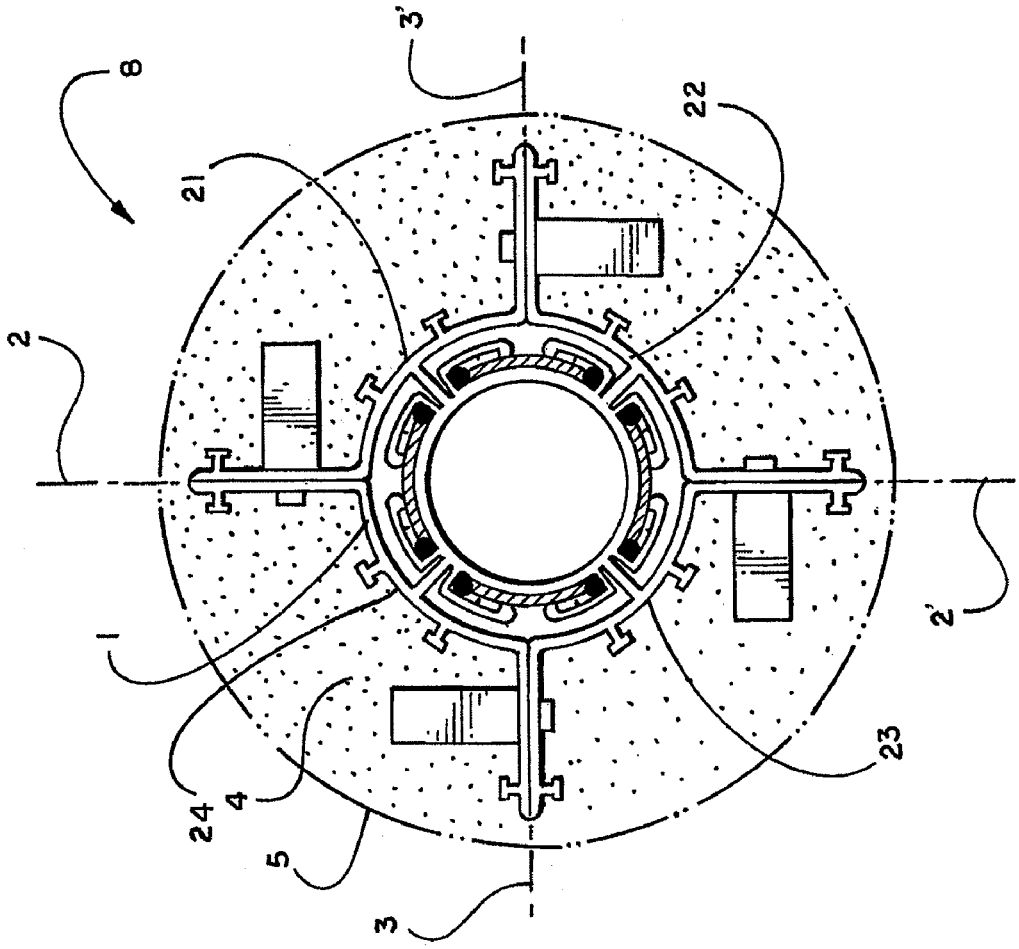
FIG. 1 is a horizontal cross-section view of a well casing having dual fracture winged initiation sections prior to initiation of multiple azimuth controlled vertical fractures.

Referring to the drawings, in which like numerals indicate like elements, FIGS. 1 and 2 illustrate the initial setup of the method and apparatus for forming either an in situ cyclic pressure pulsed or continuous injection of steam, solvent, and diluent into the oil sand deposit and for the extraction of the processed hydrocarbons. Conventional bore hole 5 is completed by wash rotary or cable tool methods into the formation 8 to a predetermined depth 7 below the ground surface 6. Injection casing 1 is installed to the predetermined depth 7, and the installation is completed by placement of a grout 4 which completely fills the annular space between the outside the injection casing 1 and the bore hole 5. Injection casing 1 consists of four initiation sections 21, 22, 23, and 24 to produce two fractures one orientated along plane 2, 2' and one orientated along plane 3, 3'. Injection casing 1 must be constructed from a material that can withstand the pressures that the fracture fluid exerts upon the interior of the injection casing 1 during the pressurization of the fracture fluid. The grout 4 can be any conventional material (if elevated temperatures are contemplated a steam injection casing cementation system is preferred) that preserves the spacing between the exterior of the injection casing 1 and the bore hole 5 throughout the fracturing procedure, preferably a non-shrink or low shrink cement based grout that can withstand the imposed temperature and differential strains.

The outer surface of the injection casing 1 should be roughened or manufactured such that the grout 4 bonds to the injection casing 1 with a minimum strength equal to the down hole pressure required to initiate the controlled vertical fracture. The bond strength of the grout 4 to the outside surface of the casing 1 prevents the pressurized fracture fluid from short circuiting along the casing-to-grout interface up to the ground surface 6.

Figure 3:
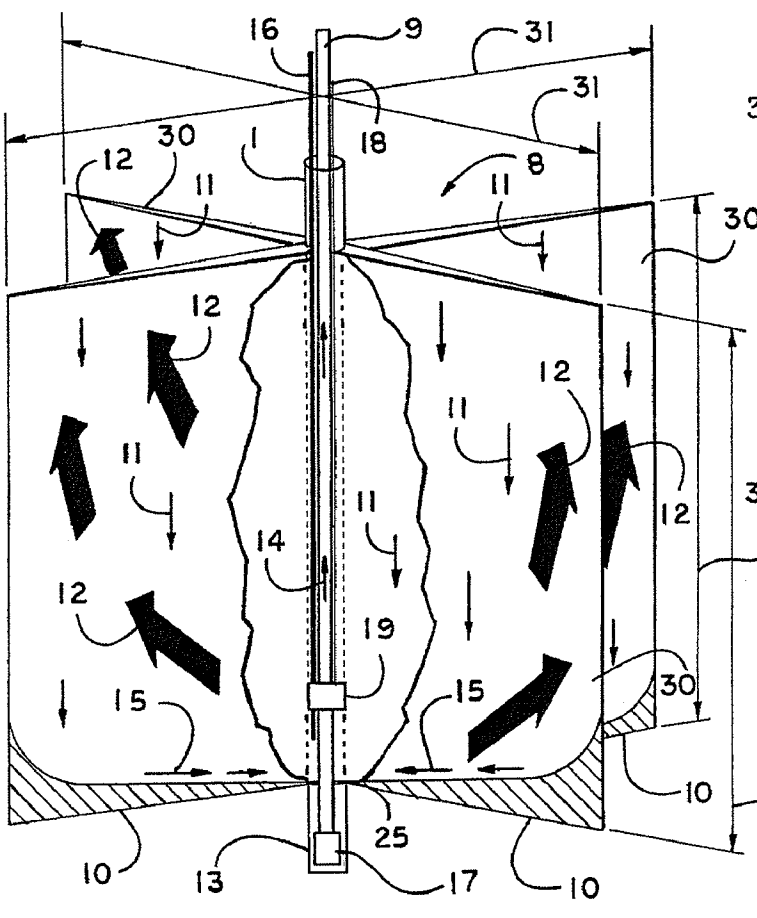
FIG. 3 is an isometric view of a well casing having dual propped fractures with downhole steam, solvent, and diluent gas injection for a cyclic pulsed pressure steam injection system.

Referring to FIGS. 1, 2, and 3, the injection casing 1 comprises two fracture dual winged initiation sections 21, 22, 23, and 24 installed at a predetermined depth 7 within the bore hole 5. The winged initiation sections 21, 22, 23, and 24 can be constructed from the same material as the injection casing 1. The position below ground surface of the winged initiation sections 21, 22, 23, and 24 will depend on the required in situ geometry of the induced hydraulic fractures and the reservoir formation properties and recoverable reserves.

The hydraulic fractures will be initiated and propagated by an oil based fracturing fluid consisting of a gel formed as a reaction product of aluminum phosphate ester and a base, typically sodium aluminate. The reaction of the ester and base creates a solution that yields high viscosity in diesels or moderate to high API gravity hydrocarbons. Gelled hydrocarbons are advantageous in water sensitive oil producing formations to avoid formation damage, that would otherwise be caused by water based fracturing fluids. Alternatively a water based fracturing fluid gel can be used.

The pumping rate of the fracturing fluid and the viscosity of the fracturing fluids needs to be controlled to initiate and propagate the fracture in a controlled manner in weakly cemented sediments such as oil sands. The dilation of the casing and grout imposes a dilation of the formation that generates an unloading zone in the oil sand, and such dilation of the formation reduces the pore pressure in the formation in front of the fracturing tip. The variables of interest are v the velocity of the fracturing fluid in the throat of the fracture, i.e. the fracture propagation rate, w the width of the fracture at its throat, being the casing dilation at fracture initiation, and $\mu$ the viscosity of the fracturing fluid at the shear rate in the fracture throat. The Reynolds number is $Re=\rho vw/\mu$. To ensure a repeatable single orientated hydraulic fracture is formed, the formation needs to be dilated orthogonal to the intended fracture plane, and the fracturing fluid pumping rate needs to be limited so that the Re is less than 100 during fracture initiation and less than 250 during fracture propagation. Also if the fracturing fluid can flow into the dilated zone in the formation ahead of the fracture and negate the induce pore pressure from formation dilation then the fracture will not propagate along the intended azimuth. In order to ensure that the fracturing fluid does not negate the pore pressure gradients in front of the fracture tip, its viscosity at fracturing shear rates within the fracture throat of ~1-20 sec-1 needs to be greater than 100 centipoise.

The fracture fluid forms a highly permeable hydraulic fracture by placing a proppant in the fracture to create a highly permeable fracture. Such proppants are typically clean sand for large massive hydraulic fracture installations or specialized manufactured particles (generally resin coated sand or ceramic in composition) which are designed also to limit flow back of the proppant from the fracture into the well bore. The fracture fluid-gel-proppant mixture is injected into the formation and carries the proppant to the extremes of the fracture. Upon propagation of the fracture to the required lateral 31 and vertical extent 32, the predetermined fracture thickness may need to be increased by utilizing the process of tip screen out or by re-fracturing the already induced fractures. The tip screen out process involves modifying the proppant loading and/or fracture fluid properties to achieve a proppant bridge at the fracture tip. The fracture fluid is further injected after tip screen out, but rather then extending the fracture laterally or vertically, the injected fluid widens, i.e. thickens, and fills the fracture from the fracture tip back to the well bore.

Referring to FIG. 3 for the intermittent cyclic pressure pulsed steam, solvent, and diluent gas injection system, the casing 1 is washed clean of fracturing fluids and a screen 25 is present in the casing as a bottom screen 25 for hydraulic connection from the casing 1 and well bore to the propped fractures 30. A downhole electric pump 17 is placed inside the casing, connected to a power and instrumentation cable 18, with downhole packer 19 and drop tube 16 for steam, solvent, and diluent gas injection, and piping 9 for production of the produced hydrocarbons to the surface. The steam, solvent, and diluent gas are injected at just below or very close to reservoir ambient pressure through the drop tube 16, through the screen 25 and into the propped fractures 30. The steam, solvent, and diluent gas contact the bitumen from the propped fracture faces, the steam heats the bitumen and the solvent diffuses into the bitumen. The mobile oil from the bitumen includes dissolved solvents and flows by gravity along with any in place water as shown by 11, to form a pool of oil 10 which flows 15 into the screens 25 and 13 into the pump 17, and is pumped 14 through the tubing 9 to the surface. The pressure of the injected gas in the propped fractures drops slightly as the steam condenses and the solvent diffuses into the bitumen, and further steam, solvent, and diluent gas is injected through the drop tube 16 to continue the cycle of progressively mobilizing the in place bitumen. The slight cyclic pressure cycling will encourage the gravity flow of the oil towards the well bore.

Figure 4:
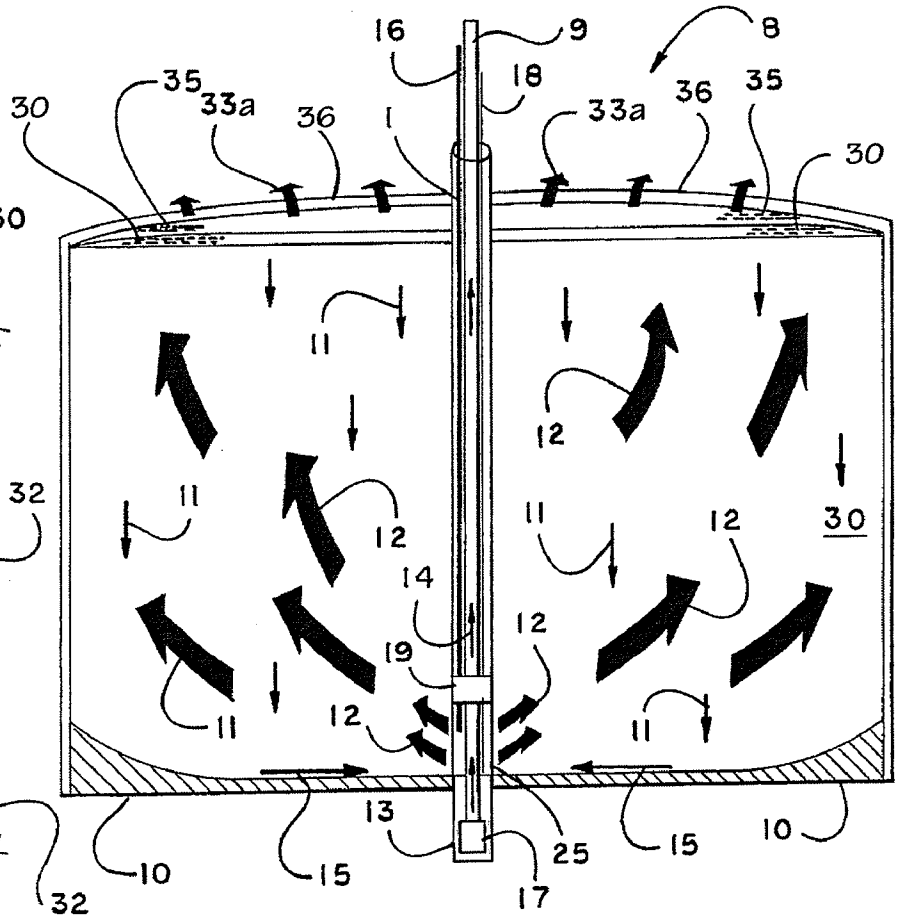
FIG. 4 is a horizontal cross-sectional side elevation view of a well casing and propped fracture showing flow of the injected gas and oil with progressive growth of the mobile oil zone.

Referring to FIGS. 3 and 4, the injected steam, solvent, and diluent gas flow as shown by vectors 12 from the screen 25 into the propped fractures 30 with proppant 34 shown and mobilized oil sand zone 35 adjacent to the propped fractures 30. The mobilized oil sand zone extends into the bitumen oil sands 36 by diffusive processes 33 due to the thermal and partial pressure gradients. The mixture of solvent and produced bitumen results in a modified hydrocarbon that flows from the bitumen 36 into the mobilized oil sand zone 35 and the propped fracture 30. The modified hydrocarbon eventually flows as 11 down to a pool of oil 10 and as flow 15 into the lower screen 25 of the well bore. The process zone includes the propped hydraulic fractures 30, the mobile zone 35 in the oil sands of the formation, and the fluid contained therein. In some cases, the casing 1 and well bore may be considered part of the process zone when a part of the process for recovering hydrocarbons from the formation is carried out in the well casing.

The mobilized oil sand zone 35 grows circumferentially 33*a*, i.e. orthogonal to the propped fractures 30, and becomes larger with time until eventually the bitumen within the lateral 31 and vertical 32 extent of the propped fracture system is completely mobilized by the injected solvent. Upon growth of the mobilized oil sand zone circumferentially to the lateral 31 and vertical 32 extent of the propped fractures 30, the contact area of the in place bitumen available for steam condensation and solvent diffusion drops dramatically from eight fracture surfaces each of an area of lateral extent 31 times vertical extent 32 plus virtually a cylindrical shape of area $2\pi$ times the lateral and vertical extents 31 and 32, down to a cylindrical shape of 5 area $2\pi$ times the lateral and vertical extents 31 and 32, i.e. from 8 plus $2\pi$ down to $2\pi$, i.e. a drop of 65% in surface contact area, assuming vertical growth of the process zone has been inhibited by placing a light non-condensing gas in the uppermost portions of the fractures. At this stage if the process is continued the growth of the mobile oil zone will become radial, and the mobilized oil will need to flow radially from the mobilized oil zone towards the fractures and well bore. It is at this stage that the process slows down and economics will determine if the injection/production process continues.

Figure 5:
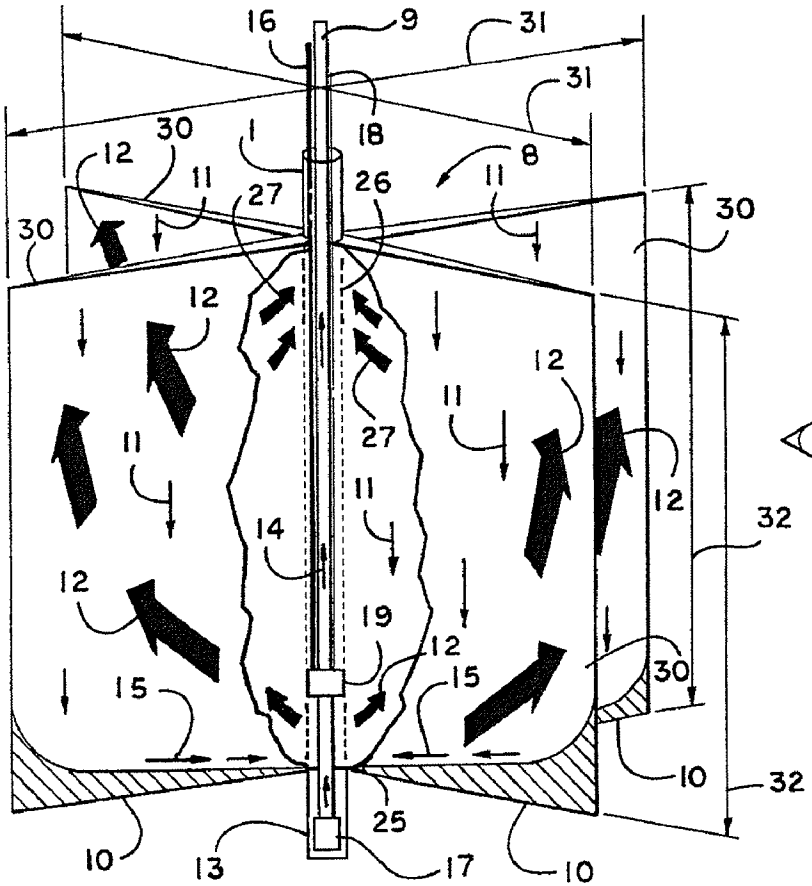
FIG. 5 is an isometric view of a well casing having dual propped fractures with downhole steam, solvent, and diluent gas injection for a continuous steam injection system.

Another embodiment of the present invention is shown on FIG. 5, for a continuous steam, solvent, and diluent gas injection system, consisting of a similar arrangement of hydraulic fractures 30, injection casing 1, a bottom screen 25 for hydraulic connection from the casing 1 and well bore to the propped fractures 30, but also a top screen 26 for connection of upper portions of the propped fractures to the casing 1 and well bore. A downhole electric pump 17 is placed inside the casing, connected to a power and instrumentation cable 18, with downhole packer 19 and drop tube 16 for steam, solvent, and diluent gas injection, and piping 9 for production of the produced hydrocarbons to the surface. The steam, solvent, and diluent gas are injected at just below or very close to reservoir ambient pressure through the drop tube 16, through the screen 25 and into the propped fractures 30. The spent tail gas, now devoid or lowered in solvent content, flows into the casing 1 through the upper screen 26, as shown by vector 27, with additional steam, solvent, and diluent gas injected through the drop pipe 16 and the spent tail gas removed through the casing 1. This system involves a continuous injection of steam, solvent, and 25 diluent gas, compared to the earlier system which was an intermittent process.

Figure 6:
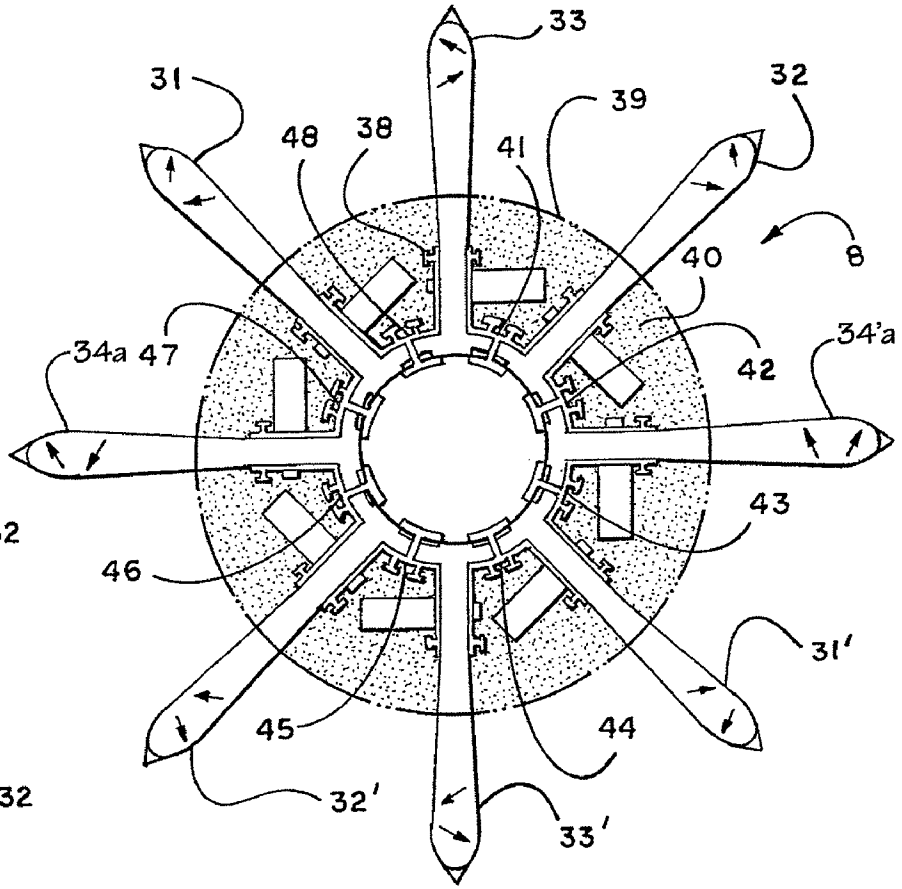
FIG. 6 is a horizontal cross-section view of a well casing having multiple fracture dual winged initiation sections after initiation of all four controlled vertical fractures.
Figure 7:
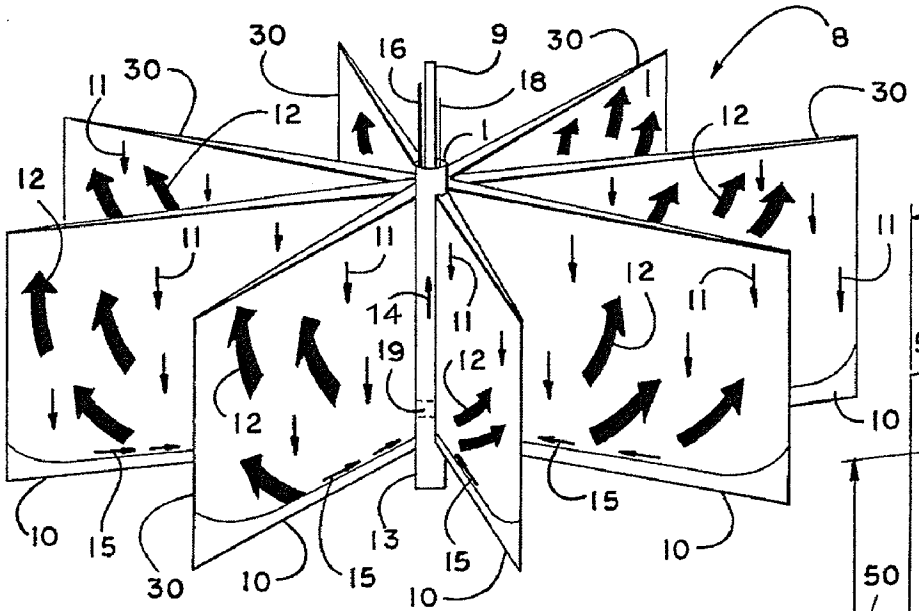
FIG. 7 is an isometric view of a well casing having four propped fractures with downhole steam, solvent, and diluent gas injection for a cyclic pulsed pressure steam injection system.

Another embodiment of the present invention is shown on FIGS. 6 and 7, consisting of an injection casing 38 inserted in a bore hole 39 and grouted in place by a grout 40. The injection casing 38 consists of eight symmetrical fracture initiation sections 41, 42, 43, 44, 45, 46, 47, and 48 to install a total of four hydraulic fractures on the different azimuth planes 31, 31', 32, 32', 33, 33', 34*a*, and 34*a*'. The process results in four hydraulic fractures installed from a single well bore at different azimuths as shown on FIG. 7. The casing 1 is washed clean of fracturing fluids and screen 25 is present in the casing as a bottom screen 25 for hydraulic connection of the casing 1 and well bore to the propped fractures 30. A downhole electric pump 17 is placed inside the casing, connected to a power and instrumentation cable 18, with downhole packer 19 and drop tube 16 for steam, solvent, and diluent gas injection, and piping 9 for production of the produced hydrocarbons to the surface. The steam, solvent, and diluent gas are injected at just below or very close to reservoir ambient pressure through the drop tube 16, through the screen 25 and into the propped fractures 30. The steam, solvent, and diluent gas contact the bitumen from the propped fracture faces, the steam heats the bitumen, and the solvent diffuses into the bitumen. The mobile oil from the bitumen includes dissolved solvents and flows by gravity along with any in place water as shown by 11, to form a pool of oil 10, which flows 15 into the screens 25 and 13 into the pump 17, and is pumped 14 through the tubing 9 to the surface. This configuration is for a cyclic pressure pulsed intermittent injection of steam, solvent, and diluent gas and could be configured similar to FIG. 5 for continuous steam, solvent, and diluent gas injection.

Figure 8:
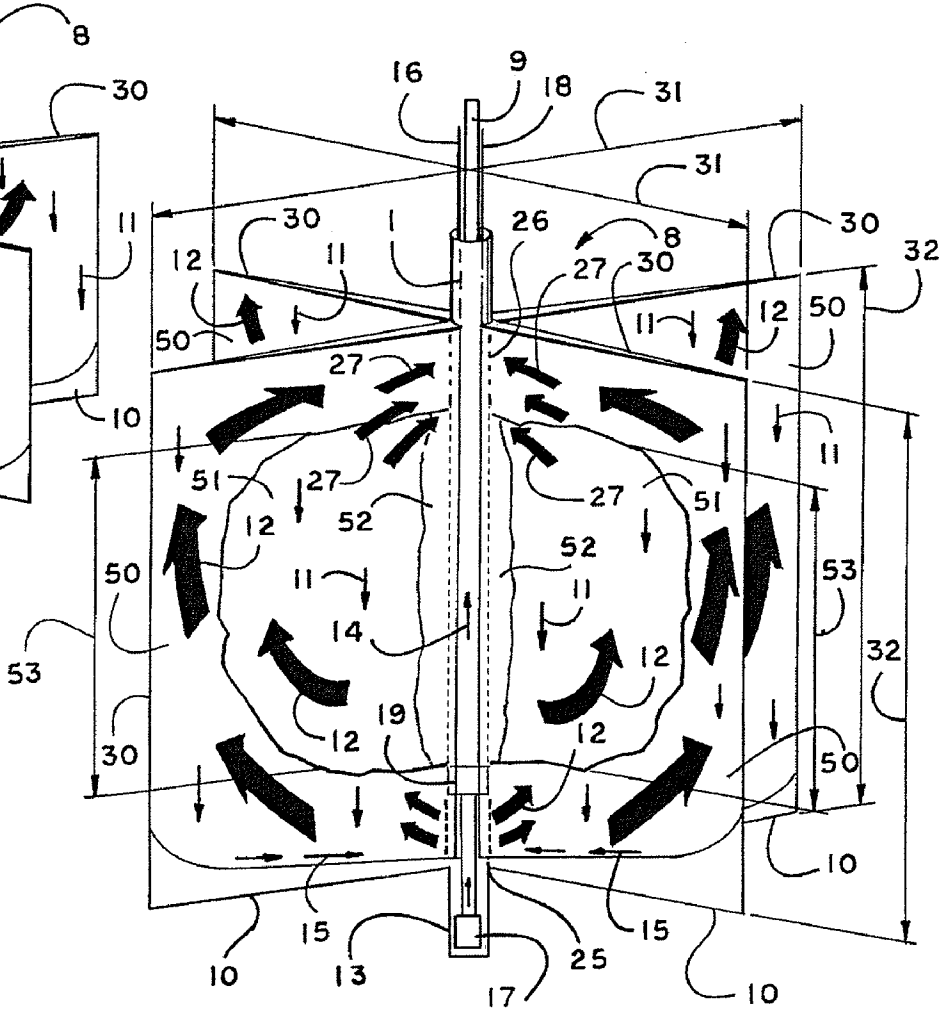
FIG. 8 is an isometric view of a well casing having dual multi-stage propped fractures with downhole steam, solvent, and diluent gas injection for a continuous steam injection system.

Another embodiment of the present invention is shown on FIG. 8, similar to FIG. 5 except that the hydraulic fractures are constructed by a multi-stage process with various proppant materials of differing permeability. Multi-stage fracturing involves first injecting a proppant material 50 to form a hydraulic fracture 30. Prior to creation of the full fracture extent, a different proppant material 51 is injected into the fracture over a reduced central section of the well bore 53 to create an area of the hydraulic fracture loaded with the different proppant material 51. Similarly the multi-stage fracturing could consist of a third stage by injecting a third different proppant material 52. By the appropriate selection of proppants with differing permeability, the circulation of the steam and vaporized solvent in the formed fracture can be extended laterally a greater distance compared to a hydraulic fracture filled with a uniform permeable proppant, as shown earlier in FIG. 5. The proppant materials are selected so that the proppant material 50 has the highest proppant permeability, with proppant material 51 being lower, and with proppant material 52 having the lowest proppant permeability. The different permeability of the proppant materials thus optimizes the lateral extent of the fluids flowing within the hydraulic fractures and controls the geometry and propagation rate of the transfer of heat and solvent to the oil sand formation. The permeability of the proppant materials will typically range from 1 to 100 Darcy for the proppant material 50 in the fracture zone, i.e. generally being at least 10 times greater than the oil sand formation permeability. The proppant material 51 in fracture zone is selected to be lower than the proppant material 50 in fracture zone by at least a factor of 2, and proppant material 52 in fracture zone close to the well bore casing 1 is selected to be in the milli-Darcy range thus limiting fluid flow in the fracture zone containing the proppant material 52.

Finally, it will be understood that the preferred embodiment has been disclosed by way of example, and that other modifications may occur to those skilled in the art without departing from the scope and spirit of the appended claims.

What is claimed is:

1. A method for in situ recovery of hydrocarbons from a hydrocarbon containing formation having an ambient reservoir pressure and temperature, comprising:

a. drilling a bore hole in the formation to a predetermined depth to define a well bore with a casing;

b. installing one or more vertical hydraulic fractures from the bore hole to create a process zone within the formation by injecting a fracture fluid at a reservoir fracturing pressure into the casing, wherein the hydraulic fractures contain a proppant;

c. placing a downhole electric pump, a downhole packer, piping, and a drop tube inside the casing, wherein said drop tube is used for steam injection;

d. injecting steam at a steam pressure through the drop tube into a section of the well casing connected to the hydraulic fractures; and e. recovering hydrocarbons from the formation through said piping.

2. The method of claim 1, further including the step of installing a bottom screen in the casing, wherein a hydraulic connection from the casing well bore to the propped fractures and the oil sand formation is established.

3. The method of claim 2, wherein the injection step includes injecting an injection gas that is a mixture of steam, a hydrocarbon solvent having a hydrocarbon solvent vapor phase, hydrogen, and carbon monoxide through the drop tube and into a section of the well casing connected to the hydraulic fractures.

4. The method of claim 3, wherein the hydrocarbon solvent is selected from the group consisting of ethane, propane, butane, or a mixture thereof.

5. The method of claim 3, wherein the steam, solvent, hydrogen, and carbon monoxide are injected at the bottom of the hydraulic fractures through the drop tube, through the bottom screen, and into the propped fractures.

6. The method of claim 3, wherein the injection gas is mixed with a diluent gas.

7. The method of claim 6, wherein the diluent gas is non-condensable under the process conditions in the process zone.

8. The method of claim 7, wherein the non-condensable diluent gas has a lower solubility in the hydrocarbons in the formation than the saturated hydrocarbon solvent.

9. The method of claim 7, wherein the diluent gas is selected from the group consisting of methane, nitrogen, carbon dioxide, natural gas, or a mixture thereof.

10. The method of claim 9, wherein the hydrocarbon solvent vapor in the injection gas is maintained saturated at or near its dew point.

11. The method of claim 9, wherein a spent tail gas is produced, additional steam and hydrocarbon solvent is added to the tail gas to create a tail gas mixture, and the tail gas mixture is re-injected into the casing.

12. The method of claim 3, wherein the dew point of the hydrocarbon solvent vapor in the injection gas is adjusted to the downhole conditions by injecting additional hydrocarbon solvent at depth to add additional hydrocarbon solvent to the injection gas.

13. The method of claim 3, wherein the hydrocarbon solvent injection is sufficient to maintain a saturated state of the hydrocarbon solvent vapor in the process zone.

14. The method of claim 3, wherein the method further includes injecting a hydrogenising gas into the well casing and thus into the process zone to promote hydrogenation and thermal cracking of at least a portion of the hydrocarbons in the process zone.

15. The method of claim 14, wherein the method further includes catalyzing the hydrogenation and thermal cracking of at least a portion of the hydrocarbons in the process zone.

16. The method of claim 14, wherein a metal-containing catalyst is used to catalyze the hydrogenation and thermal cracking reactions.

17. The method of claim 16, wherein the metal-containing catalyst is contained in a canister in the well casing.

18. The method of claim 16, wherein the proppant in the hydraulic fractures contains the metal-containing catalyst for the hydrogenation and thermal cracking reactions.

19. The method of claim 3, wherein the dissolved hydrocarbon solvent in the hydrocarbons produced from the formation is separated and recycled for re-injection.

20. The method of claim 3, wherein hydrocarbon solvent vapor saturation within the injection gas is monitored and adjusted, based on the dew point of the hydrocarbon solvent.

21. The method of claim 2, further including the step of pooling the hydrocarbon at the bottom of the hydraulic fracture, wherein the hydrocarbon enters into the well bore through the bottom screen and into the electric pump, and is pumped through said drop tube to the surface of the formation.

22. The method of claim 1, wherein the steam pressure is at just below the ambient reservoir pressure.

23. The method of claim 1, wherein the hydraulic fractures are filled with proppants of differing permeability.

24. The method of claim 1, wherein the steam injection is a pressure pulsed cyclic intermittent injection.

25. The method of claim 1, wherein the steam injection is a continuous injection.

26. The method of claim 1, further comprising controlling temperature and pressure in a majority of the process zone, wherein the temperature is controlled as a function of pressure, or the pressure is controlled as a function of temperature.

27. The method of claim 1, wherein the pressure in a majority of the process zone is at ambient reservoir pressure.

28. The method of claim 1, wherein at least two vertical fractures are installed from the bore hole at approximately orthogonal directions.

29. The method of claim 1, wherein at least three vertical fractures are installed from the bore hole.

30. The method of claim 1, wherein at least four vertical fractures are installed from the bore hole.

31. A hydrocarbon production well in a formation of unconsolidated and weakly cemented sediments having an ambient reservoir pressure and temperature, comprising:

a. a bore hole in the formation to a predetermined depth;

b. an injection casing grouted in the bore hole at the predetermined depth, the injection casing including multiple initiation sections separated by a weakening line and multiple passages within the initiation sections and communicating across the weakening line for the introduction of a fracture fluid to dilate the casing and separate the initiation sections along the weakening line;

c. a downhole electric pump, a downhole packer, piping, and a drop tube for steam injection inside the casing;

d. a fracture fluid source for delivering the fracture fluid into the injection casing with sufficient reservoir fracturing pressure to dilate the injection casing and the formation and initiate a vertical hydraulic fracture, having a fracture tip, at an azimuth orthogonal to the direction of dilation to create a process zone within the formation, for controlling the propagation rate of each individual opposing wing of the hydraulic fracture, and for controlling the flow rate of the fracture fluid and its viscosity so that the Reynolds Number Re is less than 100 at fracture initiation and less than 250 during fracture propagation and the fracture fluid viscosity is greater than 100 centipoise at the fracture tip; and e. a source for injecting steam at a steam pressure into the drop tube and the hydraulic fractures to produce hydrocarbons from the formation.

32. The well of claim 31, further including a bottom screen in the casing, wherein a hydraulic connection from the casing to the propped fractures and the oil sand formation is established.

33. The well of claim 31, wherein the source injects an injection gas that is a mixture of steam, hydrocarbon solvent having a hydrocarbon solvent vapor phase, hydrogen, and carbon monoxide.

34. The well of claim 33, wherein the hydrocarbon solvent is one of a group of ethane, propane, butane, or a mixture thereof.

35. The well of claim 33, wherein the hydrocarbon solvent is mixed with a diluent gas.

36. The well of claim 35, wherein the diluent gas is non-condensable under the process conditions.

37. The well of claim 36, wherein the non-condensable diluent gas has a lower solubility in the hydrocarbons in the formation than the saturated hydrocarbon solvent.

38. The well of claim 33, wherein the hydrocarbon solvent vapor is maintained saturated at its dew point.

39. The well of claim 33, wherein a spent tail gas is produced, additional steam and hydrocarbon solvent is added to the tail gas to create a tail gas mixture, and the tail gas mixture is re-injected into the casing.

40. The well of claim 33, wherein the dew point of the hydrocarbon solvent vapor is adjusted to the downhole conditions by employing a solvent injector at depth to add additional hydrocarbon solvent to the process zone.

41. The well of claim 33, wherein the hydrocarbon solvent injection is sufficient to maintain a saturated state of the hydrocarbon solvent vapor in the process zone.

42. The well of claim 33, wherein the well has recycling means for recovering the hydrocarbon solvent in the produced hydrocarbons for re-injection.

43. The well of claim 33, wherein the hydrocarbon solvent vapor saturation within the injection gas is monitored and adjusted, based on the dew point of the injection gas.

44. The well of claim 31, wherein the well further includes means for injecting a hydrogenising gas into the well casing and thus into the process zone to promote hydrogenation and thermal cracking of at least a portion of the hydrocarbons in the process zone.

45. The well of claim 44, wherein the well further includes means for delivering a catalyst to the process for catalyzing the hydrogenation and thermal cracking of at least a portion of the petroleum fluids in the process zone.

46. The well of claim 45, wherein the catalyst is a metal-containing catalyst is used to catalyze said hydrogenation and thermal cracking reactions.

47. The well of claim 45, wherein the catalyst is contained in a canister inside of the well casing.

48. The well of claim 45, wherein the proppant in the hydraulic fractures contains the catalyst for the process for catalyzing the hydrogenation and thermal cracking of at least a portion of the petroleum fluids in the process zone.

49. The well of claim 31, wherein the hydraulic fractures are filled with proppants of differing permeability.

50. The well of claim 31, wherein the steam injection is a pressure pulsed cyclic intermittent injection.

51. The well of claim 31, wherein the steam injection is a continuous injection.

52. The well of claim 31, further comprising controlling the temperature and pressure in a majority of the process zone, wherein the temperature is controlled as a function of pressure, or the pressure is controlled as a function of temperature.

53. The well of claim 31, wherein the pressure in a majority of the process zone is at ambient reservoir pressure.

54. The well of claim 31, wherein at least two vertical fractures are installed from the bore hole at approximately orthogonal directions.

55. The well of claim 31, wherein at least three vertical fractures are installed from the bore hole.

56. The well of claim 31, wherein at least four vertical fractures are installed from the bore hole.

* * * * *